United States Patent [19]

Lonati

[11] 3,952,548

[45] Apr. 27, 1976

[54] CAM RING

[75] Inventor: Francesco Lonati, Brescia, Italy

[73] Assignee: Costruzioni Meccaniche Lonati di Lonati Francesco & Figli (Ettore, Fausto, Tiberio) S.n.c., Brescia, Italy

[22] Filed: Jan. 2, 1974

[21] Appl. No.: 429,976

[30] Foreign Application Priority Data

Jan. 31, 1973 Italy ..... 5104/73

[52] U.S. Cl. ..... 66/57

[51] Int. Cl.[2] ..... D04B 15/32

[58] Field of Search ..... 66/57, 8, 9 A, 78, 54

[56] References Cited

UNITED STATES PATENTS

| | | | |
|---|---|---|---|
| 753,645 | 3/1904 | Steber | 66/57 X |
| 1,148,871 | 8/1915 | Steber | 66/8 |
| 1,311,093 | 7/1919 | Scott | 66/57 |
| 2,241,404 | 5/1941 | Houseman | 66/54 X |
| 3,662,572 | 5/1972 | Lonati | 66/57 X |
| 3,670,526 | 6/1972 | Martinetz | 66/57 X |
| 3,717,013 | 2/1973 | Sumitomo | 66/57 |
| 3,811,296 | 5/1974 | Bianchi et al. | 66/57 X |

FOREIGN PATENTS OR APPLICATIONS

| | | | |
|---|---|---|---|
| 1,323,158 | 2/1963 | France | 66/8 |
| 255,135 | 7/1926 | United Kingdom | 66/78 |

*Primary Examiner*—Mervin Stein
*Assistant Examiner*—A. M. Falik

[57] ABSTRACT

Improvements in or relating to the drive cam ring sets for the needles, cam followers and the like on circular knitting machines. The cams are divided into units, each of the cam units being formed on a discrete rigid plate. The individual plates having a plurality of cams thereon are in turn attachable on a rigid skirt surrounding the needle cylinder.

1 Claim, 4 Drawing Figures

CAM RING

This invention is concerned with an improvement in or relating to the drive cam ring sets for the needles, cam followers and the like both on mono- and two-cylinder circular knitting machines. More generally, the invention is concerned with improvements in or relating to the construction and assembling of said cams, as well as the skirt on which said cams are attached.

As well known, all of the drive cams for the needles, cam followers and the like on circular knitting machines are made separately and, accordingly, are assembled and attached one by one on a support skirt surrounding the needle cylinder. Because of the high amount of cams required and difference between one another, it will be readily understood that particular and special equipments are always required for the setup and profile finishing thereof, the need also existing for a proper classification thereof.

Furthermore, the assembling of these individual cams is a substantial time consuming and requires considerable labour by skilled workers, which of course would adversely affect the production costs. Moreover, said individual cams are generally attached to the support skirt at centering guideways by means of screws engaging in holes which, for practical reasons, are partially open to the cylinder, thereby providing deposit seats or receivers for slags, broken parts and so on, which could otherwise damage the outer surface of the cylinder. The plurality of cams thus attached on the skirt are often not correctly positioned to one another, so that an additional matching operation is then required for providing an accurate positioning of said cams.

It is an object of the present invention to avoid the above mentioned disadvantages and particularly to provide for an easy construction of the cams by machine tools, and a ready and simplified assembling of said cams on the associated support skirt.

It is another object of the present invention also to dispense with most of the centering guideways for the cams on the skirt (with respect to the case of the prior art), as well as the holes for the cam fastening screws, and thereby simplifying also the skirt structure and construction, and avoiding most of the receivers or seats which are usually the origin for any kind of deposit between the skirt and needle cylinder.

It is a further object of the invention to dispense with certain fittings (as required instead in the prior art devices) between adjoining cams, requiring a particular accuracy both in construction and assembling.

A still further object of the invention is to provide for advantageously undercutting or slotting and removing suitable portions of the cam skirt, so as to build up a relatively open structure and at least partially and as far as possible display the paths for the needles, cam followers, and generally the stitch forming control members.

Such objects are accomplished by the present invention, according to which the drive cams for the needles, cam followers and the like on circular knitting machines are combined in sets, each of which comprising at least two cams, the cams in each set being integrally formed on a single arcuate plate element so as to provide a unitary body member, said plate element and associated cams fast therewith being provided with members for fastening thereof as a unit to the interior of a skirt carrying the whole cam assembly.

Further details, as well as other objects and advantages of the present invention will become more apparent from the following description and appended exemplary but not limiting drawing, in which.

Figure 1:
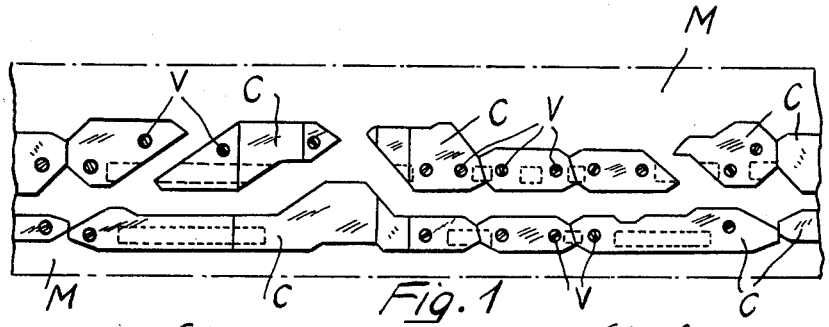
Fig. 1 PRIOR ART
FIG. 1 is a developed view showing a portion of a cam ring set on a circular knitting machine, said cams being provided and mounted on a rigid skirt, as conventionally known in the prior art.

Reference is first made to FIG. 1, showing a cam ring set having plurality of cams C, such as those ordinarily used on circular knitting machines for driving the needles, cam followers and the like; according to the prior art, these cams being separately provided, individually mounted and attached by two screws V on an annularly shaped rigid skirt M surrounding the needle cylinder (not shown) of a circular knitting machine.

Figure 2:
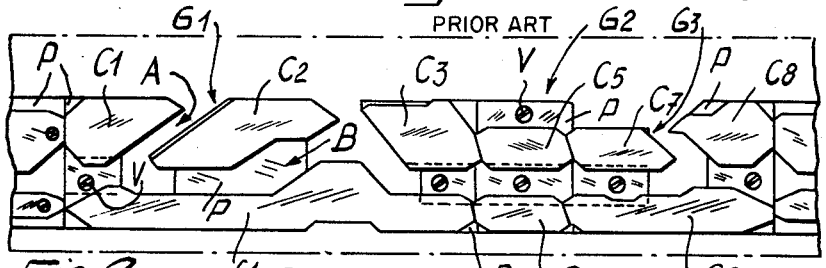
FIG. 2 is a developed view showing a portion of a cam ring set similar to that of FIG. 1, but wherein the cams are provided and mounted in accordance with the present invention.

Reference is now made to FIG. 2, which is still a developed schematic view showing a set of cams completely equivalent to the cams shown in FIG. 1, but provided in accordance with the present invention. Instead of being individually provided and mounted, it will be seen in FIG. 2 that the cams are in a combination of units, such as G1, G2, G3 . . . , each of which comprises two or more cams C1, C2, C3, C4; C5, C6; C7, C8, C9 . . . Thus, for example, the cams required on a full ring of skirt M for controlling the cam followers can be combined in a reduced amount of cam units G. All of the cams C1, . . . Cn in each cam units G1, G2, . . . are preferably provided by machining through machine tools on an arcuate plate element P, so as to form a unitary assembly and define suitable guide paths A, B for the butts of said cam followers. As apparent, the setup operations for the cams are thereby reduced, as by making the profile for one cam of a cam unit, it would be possible to make at the same time at least part of the profile for other cams in the unit, to the exclusive benefit of a reduction in setup times and costs.

Therefore, each cam unit G is a block capable of being handled and attached, as such, on the skirt M supporting the cam ring sets, preferably by only two screws V. To this end, threaded holes H for engagement with said screws V can be provided on each cam unit, particularly at said cams or along the undercuts of the paths A, B, said screws V serving the purpose of attaching the cam unit G to the skirt M. Ribs R (FIG. 3) project from the outer surface of plate P and can be accomodated within grooves provided on skirt M and forming the members for correctly positioning the cam plate on said skirt. Of course, by arranging each unitary cam unit G on the skirt M, a plurality of cams C can be easily and readily assembled, in addition to substantially reducing any inherent problems, also considerably minimizing the assembling times for the assembly, as a result.

The cams C1, C2, . . . , as integrally combined in units, are also advantageous in having an unchangeable mutual positioning, so that the accurate setup for the entire cam assembly on a circular knitting machine can be more easily and readily carried out.

Figure 3:
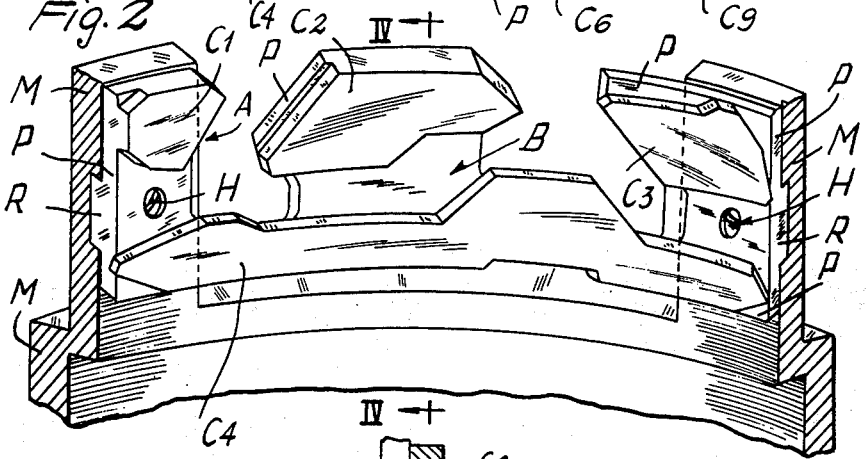
FIG. 3 is an enlarged view showing a set of four cams integral to one another, the set being attached to the skirt.
Figure 4:
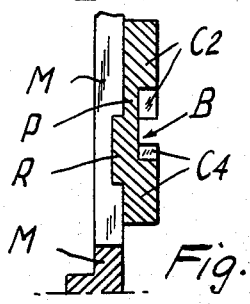
FIG. 4 is a sectional view taken along line IV-IV of the cam set shown in FIG. 3.

Furthermore, the unit-combined cams are of a per se sturdy structure, so that the skirt M can be lightened by providing as far as possible slots, splits, apertures and the like therein, as clearly shown in FIG. 3, showing in enlarged perpsective view the cam unit G1 positioned on the skirt M, and an aperture between cams C1 and C3 as shown by the solid and dash lines. Also, lightening cut outs or slots are formed on the plate element P along portions of the guide paths, A,B such as between cams C1 and C2, and between cams C2 and C3 as shown in FIG. 3. These slots at least partially display the paths for the elements (such as cam followers, sensors and the like) displaced by the cams, and also allow for discharging externally of the skirt any slags or pieces of instruments being broken during the use and operation of the circular knitting machine.

Therefore, still in accordance with the above described invention, the cams for both mono- and two-cylinder circular knitting machines are made in units of at least two cams as shaped projections on an arcuate plate, so as to form a mutual unitary body member, said units comprising at least two cams being attached within the skirt surrounding the needle cylinder of the circular knitting machine.

What I claim is:

1. An improvement in the drive cam ring set of a circular knitting machine, comprising:

an annular shaped rigid skirt;

a plurality of arcuate plate members each having a positioning means for positioning each said arcuate plate member within said annular shaped rigid skirt; and at least two cams formed integrally on each of said arcuate plate members, said cams forming a guide path having slots along portions of said path between portions of said cams, said annular shaped rigid skirt having apertures at locations around its circumference adjacent said slots thereby providing radial openings through both said annular shaped rigid skirt and said arcuate plate members.

* * * * *